US005711081A

United States Patent [19]

Zaccaria

[11] Patent Number: 5,711,081

[45] Date of Patent: Jan. 27, 1998

[54] DEVICE AND METHOD FOR CONSTRUCTION

[76] Inventor: Antoine Tony Zaccaria, 8537 Autumn Woods, Miamisburg, Ohio 45342

[21] Appl. No.: 739,945

[22] Filed: Oct. 30, 1996

[51] Int. Cl.[6] ..... E04G 21/18

[52] U.S. Cl. ..... 33/409; 33/407

[58] Field of Search ..... 33/409, 410, 407, 33/408, 413

[56] References Cited

U.S. PATENT DOCUMENTS

| | | | |
|---|---|---|---|
| 847,824 | 3/1907 | Roberts | 33/409 |
| 2,603,875 | 7/1952 | Kroll | 33/409 |
| 2,623,290 | 12/1952 | Kampel | 33/409 |
| 2,667,695 | 2/1954 | Price | 33/409 |
| 2,735,183 | 2/1956 | Taylor | 33/409 |
| 2,785,467 | 3/1957 | Anderson | 33/408 |
| 2,834,112 | 5/1958 | Seagraves | 33/409 |
| 3,148,453 | 9/1964 | Di Carlo | 33/410 |
| 3,276,129 | 10/1966 | Andrews | 33/407 |
| 3,440,728 | 4/1969 | Hackworth, Sr. | 33/410 |
| 5,003,701 | 4/1991 | Hughes et al. | 33/409 |
| 5,009,015 | 4/1991 | Redl | 33/409 |

*Primary Examiner*—Thomas B. Will
*Attorney, Agent, or Firm*—R. William Graham

[57] ABSTRACT

A device for construction includes a first member for retaining the first member in a predetermined position with respect to a first construction element, a second member for retaining the second member in a predetermined position with respect to a second construction element, and an elastic member interconnecting the first member and the second member such that the elastic member provides a line of measurement by which additional construction elements may be aligned for the purpose of construction and a method of construction employing the same.

8 Claims, 2 Drawing Sheets

DEVICE AND METHOD FOR CONSTRUCTION

BACKGROUND OF THE INVENTION

1. Field of the Invention

The present invention relates to the field of construction. More particularly, but not by way of limitation, the invention relates to a device for aiding in the construction field of masonry.

2. Related Art

There exist devices and techniques for aiding in the construction field of masonry. Particularly, there exist devices and methods for aiding in the construction of walls and the like out of various types of construction elements, such as brick and mortar. One commonly employed device includes the use of nails and string in the construction of a wall, wherein a nail is connected to a respective construction element (brick) and another nail connected to another construction element which is displaced from the other construction element and the string is tied to the nails to form a line of measurement by which the other construction elements may be aligned for building the wall.

One problem with such technique is that the string must be kept taught to obtain an accurate line of measurement. In doing so, however, the line will frequently cause a strain on the end construction elements resulting in a bowing of the outer wall. Thus, there is a constant balancing of the need of line tension verses end wall plumbing. This and other similar techniques are also time consuming and not very effective.

There is a need to improve the method of construction if the field of masonry. There is also a need for a device for use in the field of masonry which aids in the construction of walls and the like. Accordingly, the present invention solves the aforesaid problems.

BRIEF SUMMARY OF THE INVENTION

It is an object to improve construction.

It is another object to improve the field of masonry.

It is yet another object to provide a device which improves the field of construction.

It is still another object to provide a device which improves the field of masonry.

Accordingly, the present invention is directed to a device for construction which includes a first member having means for retaining the first member in a predetermined position with respect to a first construction element, a second member having means for retaining the second member in a predetermined position with respect to a second construction element, and an elastic member interconnecting the first member and the second member such that the elastic member provides a line of measurement by which additional construction elements may be aligned for the purpose of construction.

Additionally, the present invention includes a method of construction which includes the steps of (a) disposing a first construction element on a construction surface, (b) positioning a first member adjacent the first construction element having means for retaining the first member in a predetermined position with respect to the first construction member, (c) disposing a second construction element on a construction surface, (d) positioning a second member adjacent the second construction element having means for retaining the second member in a predetermined position with respect to the second construction member, (e) interconnecting the first member and second member with an elastic member to form a line of measurement by which additional construction elements may be aligned and (f) disposing an additional construction element on the construction surface adjacent and in alignment with the line of measurement for the purpose of the construction.

Other objects and advantages will be readily apparent to those skilled in the art upon viewing the drawings and reading the detailed description hereafter.

DETAILED DESCRIPTION OF THE INVENTION

Figure 1:
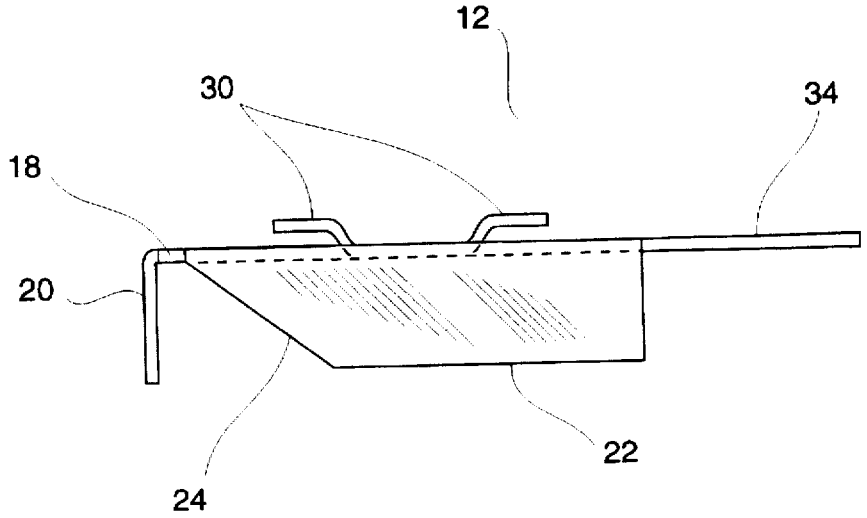
FIG. 1 is a side view of the present invention.
Figure 2:
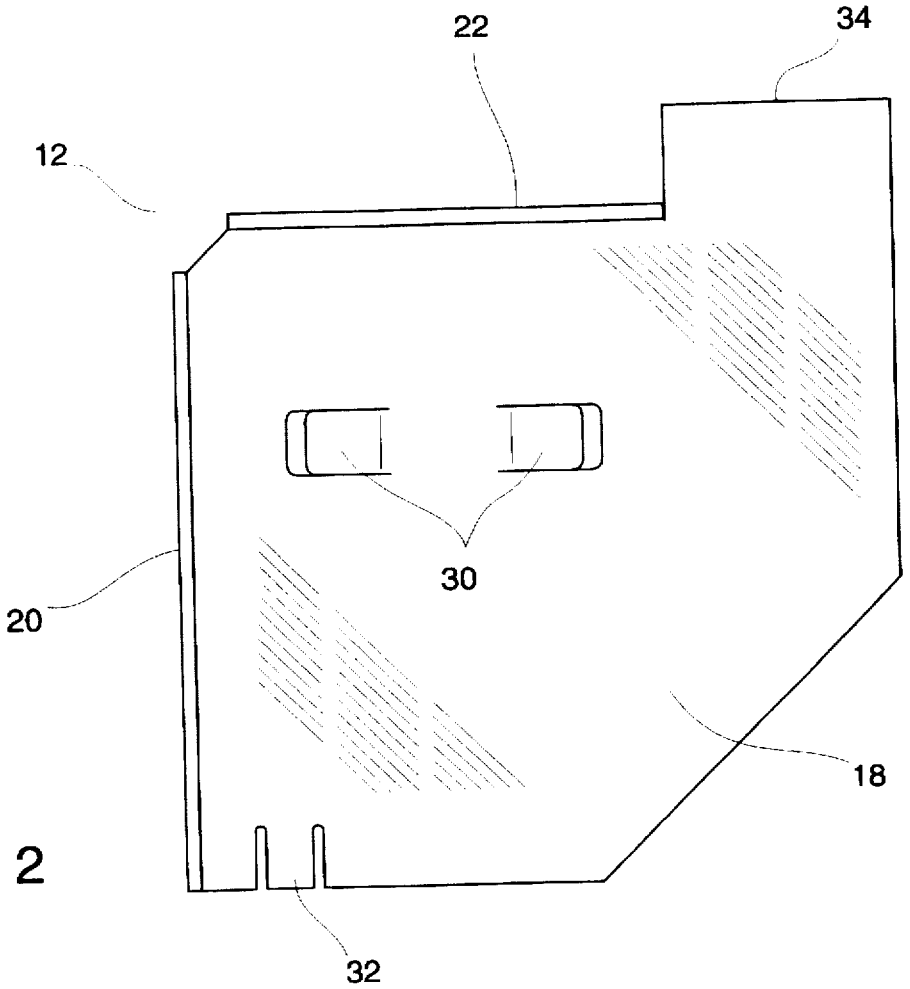
FIG. 2 is a bottom view of the present invention.
Figure 3:
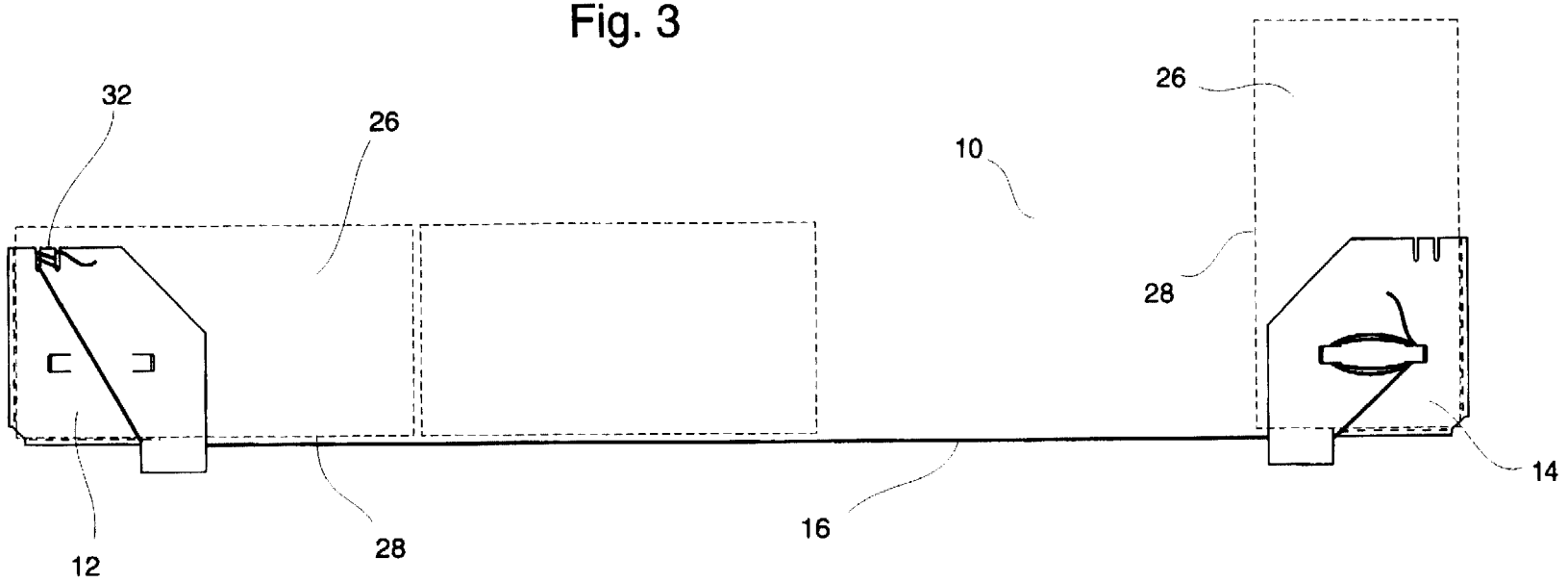
FIG. 3 is a top plan view of the device of the present invention in use.
Figure 4:
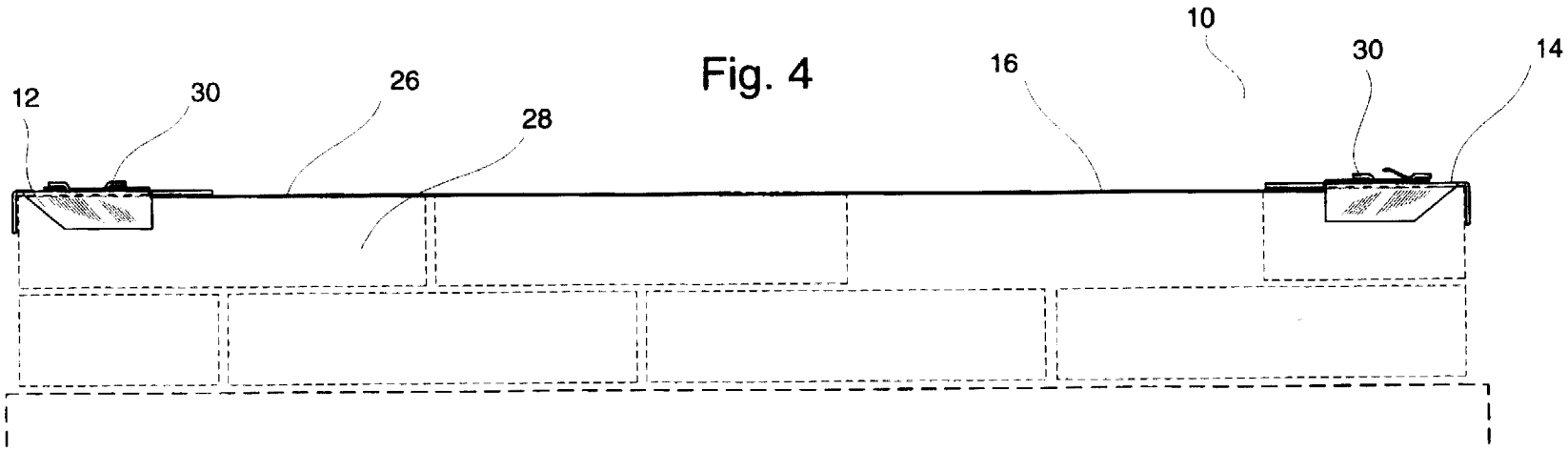
FIG. 4 is a side plan view of the device of the present invention in use.

Referring now to drawings, the device is generally referred to by the numeral 10. The device 10 includes members 12 and 14 and elastic member 16. The members 12 and 14 can be made of a suitable rigid material and formed in a manner to carry out the objectives stated herein, the details of which are set forth below.

The members 12 and 14 are similarly formed and accordingly member 12 is described as such with the understanding that member 14 includes similar elements. The member 12 includes a base plate portion 18 which is relatively planar and has a pair of flanges 20 and 22 formed at a predetermined angle (preferably 90°) with respect to each other and at a predetermined angle (preferably 90°) with respect to the base plate portion 18. In this regard, the flanges 20 and 22 and base plate portion 18 form a surface 24 which is preferably configured to receive a surface portion 26 of a construction element 28, such as a brick. As will be later apparent, the surface 24 acts as a retainer to hold the member 12 in place with respect to the construction element 28 when in use. While two flanges 20 and 22 are shown, it may be sufficient to use only one flange to carry out the invention.

Connected to the base plate portion 18 is an elastic member retainer 30. The elastic member retainer 30 serves as a means for which the elastic member 16 may be wrapped around in order to readily adjust the tension of the elastic member 16 to an acceptable working range, i.e., providing sufficient tension to keep from sagging when in use but not too tight as to be over bearing on the construction element 28. Optionally, a notched surface portion 32 is provided as a point to which an end of the elastic member 16 may be secured.

The base portion 18 has a protruding portion 34 which extends in the same plane as the base portion adjacent the flange 22. The protruding portion 34 serves as a point about which the elastic member 16 wraps to extend beyond the flange 22 and substantially avoid coming into contact with construction elements 28 during the intended construction.

In carrying out the use of the device 10, a method of construction is as follows. A first construction element is disposed on a construction surface. A first member is positioned adjacent the first construction element having means for retaining the first member in a predetermined position with respect to the first construction member. A second construction element is disposed on a construction surface. A second member is positioned adjacent the second construction element having means for retaining the second member in a predetermined position with respect to the second construction member. The first member and second member are interconnected with an elastic member to form a line of measurement by which additional construction elements may be aligned. Additional construction elements are disposed on the construction surface adjacent and in alignment with the line of measurement for the purpose of the construction, such as a wall.

The above described embodiment is set forth by way of example and is not for the purpose of limiting the present invention. It will be readily apparent to those skilled in the art that obvious modifications and variations can be made to the embodiment without departing from the scope of the invention. Accordingly, the claims appended hereto should be read in their full scope including any such modifications and variations.

What is claimed is:

1. A device for use in aligning construction elements, which includes:

a base plate portion having a first edge and a second edge joining at a predetermined angle and a third edge joining said second edge joining at a predetermined angle;

a first flange extending from a part of said first edge at a predetermined angle from said base plate portion;

a second flange adjacent said first flange extending from said second edge at a predetermined angle from said base plate portion;

wherein said base plate portion, said first flange and said second flange form an inner retention surface portion configured to fit an outer surface portion of the construction element;

a protruding portion adjacent said first flange and extending from another pan of said first edge; and a notched surface portion formed in said third edge of a predetermined size.

2. The device of claim 1, wherein said first edge and said second edge join at about 90°, said first flange extends from said first edge at about 90° from said base plate portion, said second flange extends from said second edge at about 90° from said base plate portion.

3. The device of claim 1, wherein said third edge has a pair of laterally spaced notched surfaces.

4. A device for use in aligning construction elements, which includes:

a first member and a second member, wherein each member includes:

a base plate portion having a first edge and a second edge joining at a predetermined angle and a third edge joining said second edge joining at a predetermined angle;

a first flange extending from a part of said first edge at a predetermined angle from said base plate portion;

a second flange adjacent said first flange extending from said second edge at a predetermined angle from said base plate portion;

wherein said base plate portion, said first flange and said second flange form an inner retention surface portion configured to fit an outer surface portion of the construction element;

a protruding portion adjacent said first flange and extending from another part of said first edge;

a notched surface portion formed in said third edge of a predetermined size; and an elastic member interconnecting said first and second members so that the construction elements may be aligned by said elastic member when said first and second members are operatively disposed on the construction elements.

5. The device of claim 4, such that when said members are disposed on the construction elements said protruding portions extend in a common direction and wherein one end of said elastic member is retained within said notched surface portion of said first member and another end of said elastic member is retained within said notched surface portion of said second member and an intermediate portion of said elastic member is disposed about and between said protruding portions.

6. The device of claim 4, wherein said elastic member is of a predetermined diameter and has a first end retainingly disposed in said notched surface portion of said third edge of said first member, a first intermediate portion extending transversely across an outer surface portion of said base plate portion of said first member to a point adjacent said first flange and said protruding portion of said first member and further extended about said protruding portion of said first member in a manner to hold a second intermediate portion of said elastic member generally in a plane of said first flange of said first member, a second end of said elastic member retainingly disposed in said notched surface portion of said third edge second member, a third intermediate portion of said elastic member extending transversely across an outer surface portion of said base plate portion of said second member to a point adjacent said first flange and said protruding portion of said second member and further extended about said protruding portion of said second member in a manner to hold a fourth intermediate portion of said elastic member generally in a plane of said first flange of said second member, a fifth portion of said elastic member interconnecting said second portion and fourth portion of said elastic member.

7. The device of claim 4, wherein said first edge and said second edge join at about 90°, said first flange extends from said first edge at about 90° from said base plate portion, said second flange extends from said second edge at about 90° from said base plate portion.

8. The device of claim 4, wherein said third edge has a pair of laterally spaced notched surfaces.

* * * * *